United States Patent [19]

Sulewsky

[11] 4,213,516

[45] Jul. 22, 1980

[54] ACOUSTICAL WALL PANEL

[75] Inventor: James E. Sulewsky, Mendham, N.J.

[73] Assignee: American Seating Company, Grand Rapids, Mich.

[21] Appl. No.: 964,675

[22] Filed: Nov. 29, 1978

[51] Int. Cl.[2] ..... E04B 1/82

[52] U.S. Cl. ..... 181/286; 181/292

[58] Field of Search ..... 181/286, 290–294, 181/287; 428/116–118

[56] References Cited

U.S. PATENT DOCUMENTS

| | | | |
|---|---|---|---|
| 1,554,179 | 9/1925 | Trader | 181/293 |
| 2,285,423 | 6/1942 | Esser | 181/290 |
| 2,703,627 | 3/1955 | D'Eustachio | 181/286 |
| 2,824,618 | 2/1958 | Hartsfield | 181/290 |
| 3,021,914 | 2/1962 | Wilson | 181/290 |
| 3,177,970 | 4/1965 | Boschi | 181/290 |
| 3,216,167 | 11/1965 | Roberts et al. | 181/290 |
| 3,448,823 | 6/1969 | Smith | 181/290 |
| 3,592,288 | 7/1971 | Walter | 181/287 |
| 3,844,875 | 10/1974 | Chamberlain | 181/291 |
| 3,887,031 | 6/1975 | Wirt | 181/292 |
| 3,949,827 | 4/1976 | Witherspoon . | |
| 4,097,633 | 6/1978 | Focht | 181/286 |

*Primary Examiner*—L. T. Hix
*Assistant Examiner*—Benjamin R. Fuller
*Attorney, Agent, or Firm*—Emrich, Root, Lee, Brown & Hill

[57] ABSTRACT

An acoustical wall panel has a core of a plurality of layers of glass fiber pressed together and having a density ranging from approximately two pounds per cubic foot at the front surface to approximately six pounds per cubic foot at the rear surface. A plurality of cavities are formed on the front surface of the core. The front of the panel is covered with fabric, and the rear is covered with a septum to provide a barrier to the transmission of sound pressure waves. The cross-sectional area, depth and spacing of the cavities are selected to improve absorption of sound in the intelligence range of speech while having less absorption in the lower frequency range to permit a desirable background or ambient noise to exist. The spacing and shape of the cavities also provides a smooth, continuously changing curvature in the cavity side walls to increase the surface area and enhance the capacity of the panel to absorb sound at flanking angles of incidence.

7 Claims, 5 Drawing Figures

ACOUSTICAL WALL PANEL

BACKGROUND AND SUMMARY

The present invention relates to acoustical panels; and more particularly, it relates to an improved acoustical wall panel. Acoustical panels of the type with which the present invention is concerned have particular utility in "open plan" offices and schools. Open plan systems do not use conventional floor-to-ceiling walls to separate rooms—rather, individual wall panels are ganged together to define these areas. The height of the wall panels may vary, for example, in the range of 5–7 feet, and the widths may be 18–48 inches. Such panels need not be secured to the floor, and they terminate short of the ceiling.

Open plan office and school systems have received increased acceptance during recent years because of the ease of construction, relatively low cost, and flexibility. In an effort to further acceptance of these systems, attempts have been made to incorporate acoustical designs into open plan panels.

A typical acoustical panel for an open plan system which is used throughout the industry today is a glass fiberboard comprised of a plurality of layers of glass fiber and having a density of approximately six pounds per cubic foot. This panel does not absorb as much sound as is desired in the range of 500 Hz to 4,000 Hz.

Human perception of speech in the range of 400–8,000 Hz (sometimes referred to herein as the intelligibility range) has a disturbing effect if it is present in ambient noise because it is in this frequency range that intelligence is carried—such as the sounds of vowels and consonants. Thus, if sound is not absorbed in this range, it is distracting to a person who perceives it. Office machines are a source of noise in a band around 500 Hz, and the human voice is a source of noise in the range around 4,000 Hz. Thus, a panel which is deficient in absorbing incident sound at these frequencies is not an effective material for use in open plan systems.

Another disadvantage of the one-inch, six-pound density glass fiberboard is that the surface density is high enough that high frequency sound does not penetrate the surface efficiently—rather, it has a tendency to reflect, especially when the angle of incidence is acute (0 degrees to 45 degrees). This is sometimes referred to as to "flanking" angle, and it is particularly important in open office systems where a single wall extending in one plane may define two sides of adjacent rooms, with a separating wall extending perpendicular from it. If the separating wall is spaced from the long wall (for example, to form a door opening), then higher frequency sounds have a tendency to skip off the longer wall and penetrate into an adjacent room. Since these higher frequency sounds are in the intelligibility range, they become acoustical noise to the observer.

Another important aspect of an acoustical panel for offices and the like is that they not be too efficient in absorbing sound at frequencies below 400 Hz. The reason for this is that it has been found desirable to permit a certain amount of low frequency ambient sound for psychological reasons. These sounds are present as background and do not disturb or command the attention of one who perceives them. Rather, they have a quieting or reassuring effect provided they are not of such intensity as to command attention.

The present invention provides an acoustical wall panel having a core comprised of a plurality of layers of glass fiber which are pressed together under the application of heat and pressure. As many as three layers of the material, originally having a density of one pound per cubic foot, are laminated together to form a board having a nominal thickness of one inch. A resulting density variation from the front surface of the board to the rear surface ranges from approximately two pounds per cubic foot at the front suface to approximately six pounds per cubic foot at the rear surface. Further, a plurality of cavities are formed on the front surface. These may be provided by cylindrical projections (rods, stubs or pins) on one surface of the mold.

The board is provided with an impermeable back membrane or septum which, in the illustrated embodiment, is a sheet of aluminum having a thickness of 0.001 in.

The front of the panel is covered with fabric or other material which may be decorative, but also permits the sound pressure wave to enter the cavities formed in the front surface of the board.

The side walls of the cavity have a generally circular cross section which increases from the bottom of the cavity to the outer surface of the board to provide a smooth conformation from the bottom of the cavity to the outer surface of the wall. The cavities function as resonators to confine high frequency sound energy that enters through the permeable fabric covering until it is absorbed or attenuated by the air in the cavities. The pattern of placement of the cavities (preferably in a square or slightly diamond-shaped pattern) is such as to "tune" the board to enhance coupling of incident sound pressure waves into the cavities over a selected range of frequencies in the intelligibility range. For example, in a preferred embodiment, there are two spacings between cavities. One may be thought of as taken along the diagonal of the grid pattern, and the other is taken along a side. These two dimensions correspond to two quarter-wavelengths of sound in the lower portion of the intelligibility range so as to increase sound absorption. This increased absorption continues to the higher end of the intelligibility frequency range where the absorption is further enhanced by preserving the rough surface texture of the panel and by increasing the effective surface area due to the formation of the cavities on the outer surface of the panel.

By forming the glass fiber according to the present invention, the texture of the lower density layers is preserved at the outer surface of the inner or core material (namely the glass fiber). Thus, the core has a density of approximately two pounds per cubic foot at the surface, but it increases in the direction from the front surface to the rear surface, until it attains a density of six pounds per cubic foot at the rear surface. This density variation need not be a uniform, gradual increase in density, rather, it has been found that it increases from two pounds to approximately four pounds and then to approximately six pounds per cubic foot. The lower density material is efficient in surface-absorption of high frequency energy. The four pound per cubic foot density is effective to absorb the intermediate range (in the neighborhood of 400–500 Hz); and it is located at a position where the intermediate frequencies have greater penetration. Finally, the innermost section, having a density of approximately six pounds per cubic foot, is effective in absorbing the lower frequencies in a controlled manner. The septum acts as a barrier to prevent transmission of sound pressure waves.

Thus, by forming the core of the composite board in the manner described and by using the materials and density indicated, the texture of the outer surface is preserved for enhancing absorption of higher frequencies.

Further, the dimpled structure of the outer surface has a two-fold effect on incident sound at a flanking angle (that is, an included angle of incidence of 45 degrees or less). Considering that a sound pressure wave is transmitted with a generally spherical wave front and that the portion of the curved side wall of a cavity that the source of sound sees along the panel changes continuously, and further considering that the placement of the cavities is designed for particular frequency ranges, the first effect is that the source of sound or noise "sees" different portions of the curved cavity walls, and therefore at least some of the sound wave is incident to the cavity wall at a perpendicular angle, at which absorption is greatest. Secondly, any reflected sound is reflected at continuously varying angles because the angle of incidence changes for each cavity. This has the effect of dispersing the incident sound, causing it to lose its articulation and become less distracting.

The present invention thus provides an acoustical panel which has a frequency absorption characteristic which is better suited for use in an open plan setting in that it exhibits a frequency absorption characteristic which has high absorption for the higher frequencies which are perceived as noise by a human, which reduces the transmission of high frequency noise through flanking, yet which permits a controlled amount of low frequency or background noise for psychological assurance.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
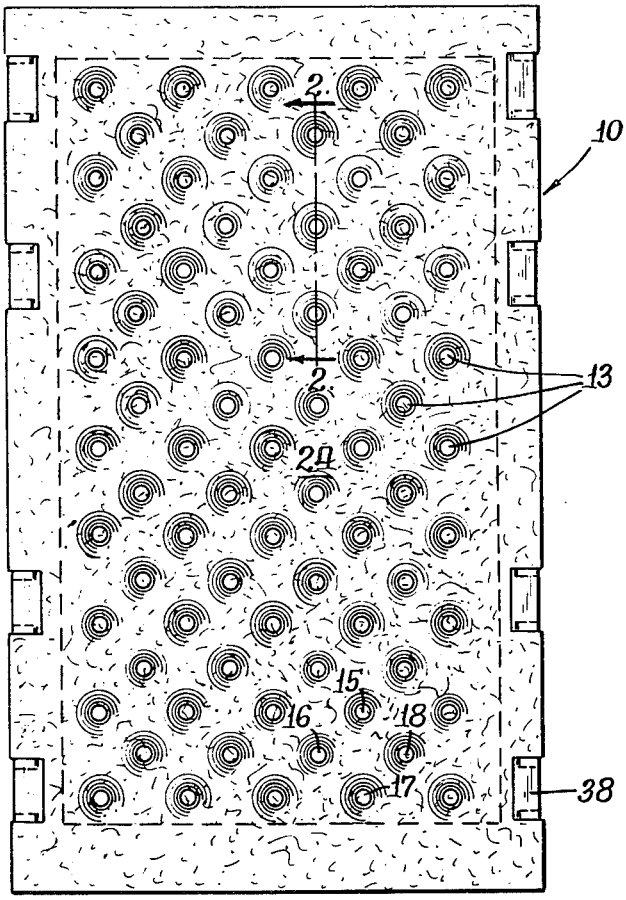
FIG. 1 is a front view of a core of an acoustical panel constructed according to the present invention.

Referring first to FIG. 1, reference numeral 10 generally designates an acoustical panel which may be of any desired dimensions. For example, in one commercial embodiment, two standard heights are provided of 58 5/16 inches and 75 5/16 inches. In each of these heights, six different widths may be provided ranging from a nominal 18 inches to a nominal 48 inches. The present invention lends itself to other heights and widths.

Figure 2:
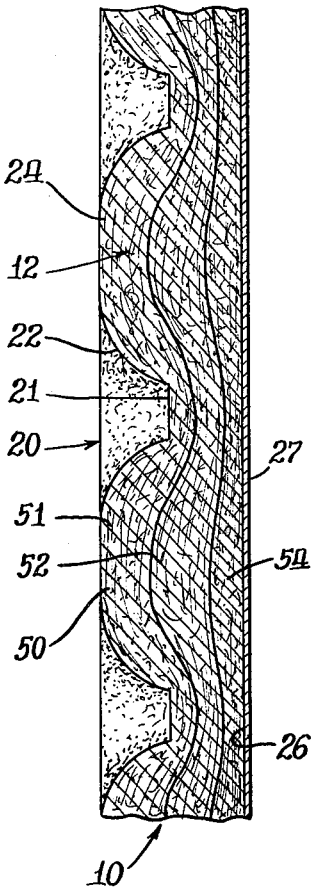
FIG. 2 is a fragmentary close up cross-sectional view taken through the sight line 2—2 of FIG. 1.

The core 10 is formed of a plurality of layers of glass fiber mats, diagrammatically illustrated in FIG. 2 as the stratified layers 12, which are laminated together under heat and pressure. A plurality of cavities or depressions 13 are formed by means of cylindrical rods or pins in one surface of the mold.

In the illustrated embodiment, the centers of the cavities are arranged in a square grid pattern. Thus, four apertures designated 15, 16, 17 and 18 have their centers defining a square. The distance between adjacent cavities (such as 15, 16 or 15,18) is less than the distance between cavities along a diagonal (15, 17, or 16, 18). These two spacings, in a preferred embodiment, are selected so as to be tuned to two different frequencies in the intelligibility range so as to increase sound absorption in that range. Specifically, where the sound absorption coefficient of previous glass fiberboards began to fall off at about 1,000 or 2,000 Hz, the spacing of cavities in the present invention is designed to increase sound absorption at these frequencies and to even further increase it in the mid range of the intelligibility range (approximately 4,000 Hz).

Specifically, the diagonal distance between cavities (15, 17 or 16, 18) is set to be about 2.1 inches. The distance between cavities along a side of the square of the grid pattern is set to be approximately 1.45 inches.

The cavities formed by the rods or stubs in the mold, as described above, have a profile which is illustrated in FIG. 2. Referring to the cavity generally designated 20, it has a circular cross section starting from a bottom wall 21, and this cross section increases continuously from the bottom wall 21 to the outer surface of the board. Thus, the side wall 22 has a smooth conformation from the bottom wall 21 of the cavity to the outer surface 24 of the glass fiber core 10. This bell-like shape opens outwardly toward the room in which it is desired to control sound. As indicated above, the surface which faces the room in which sound is being controlled is referred to as the front surface of the panel or core, and the other surface is referred to as the rear surface (designated 26 in FIG. 2).

A sheet of air-impervious material 27 is applied to the back of the core 10. This may be a sheet of aluminum foil having a thickness of one mil. Other thicknesses and septum materials may equally well be employed. The septum 27 is applied to the rear surface 26 of the core preferably by means of a chemical bonding agent.

Figure 3:
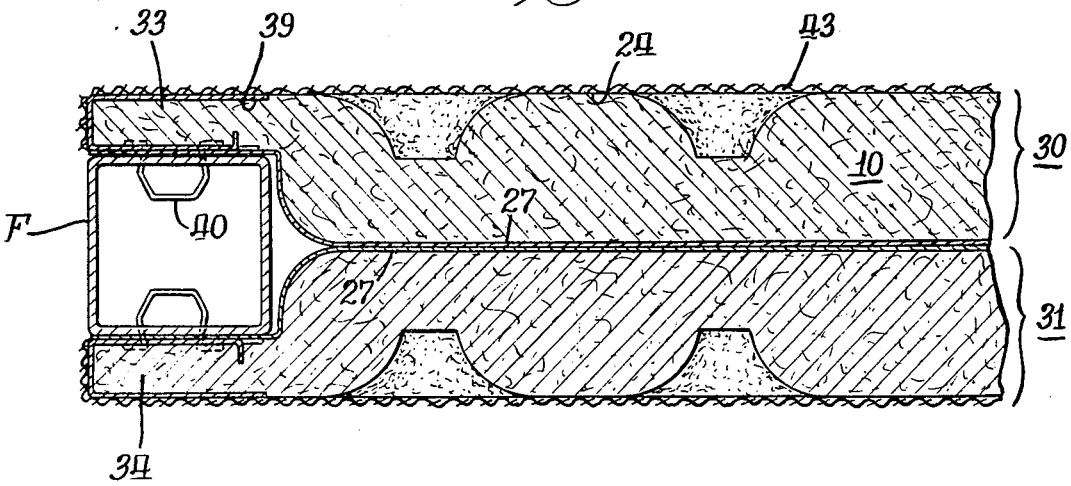
FIG. 3 is a close up fragmentary horizontal cross-sectional view of two acoustical panels connected back-to-back to a peripheral support frame.

Referring now to FIG. 3, portions of two separate panels 30, 31 are illustrated as being connected to a common peripheral frame F. As illustrated, these panels are connected back-to-back, and although the septums 27 are illustrated as touching, there may in fact be a slight gap between the opposing rear surfaces of these septum sheets in practice. As seen in FIG. 3, each of the panels 30, 31 has a peripheral border 33,34 respectively which are formed at the same time the main body of the core is formed, but by pressing the glass fiber to an even greater density, to provide rigidity to the panel. Further, during the initial molding process, recesses are formed such as the one designated 38 in FIG. 1, for receiving clip supports 39 into which clips 40 are fitted for securing the panel to the frame F. Additional details concerning the formation of the peripheral borders 33, 34, the frame F, and the manner of attaching the acoustical panels to the frame may be found in the co-pending, co-owned application of Omholt and Knapp entitled *REMOVABLE ACOUSTICAL PANEL FOR PANEL WALL SYSTEMS.* Not forming any necessary part of the present invention, these aspects need not be discussed in further detail herein.

The outer surface 24 of the panel 30 is covered with a layer of fabric 43 which extends around the border 33 and is applied to the rear surface of the border by adhesive or other means.

One of the functions of the cloth 43, of course, is to provide a decorative or aesthetic look to the panels; but it also acts as a pervious layer which permits incident sound pressure waves to enter into the cavities formed in the core 10 of the panel where the sound is absorbed. Because these cavities are air-filled and because the sound absorption coefficient of air increases with frequency, the cavities are effective in absorbing the higher frequency sounds, particularly in the intelligibility range. Further, by placing the cavities as described above, so as to correspond to the quarter wavelengths of selected frequencies in the intelligibility range, the transmission of sound pressure waves into the cavities is enhanced. Still further, the texture of the outer layer of glass fiber is preserved in the "pillow" areas between cavities. That is, referring to FIG. 2, by forming the core 10 by placing a plurality of of individual layers of glass fiber and then pressing them together, the stratifications in the area of a pillow 50 remain at a relatively low density toward the surface, such as in the area designated 51. In this area, the density of the glass fiber is approximately two pounds per cubic inch. As one proceeds toward the center of the pillow, in the region designated 52, the density increases to approximately four pounds per cubic inch; and in the innermost regions such as that designated 54, the density increases to six pounds per cubic inch.

Thus, the lower density material is at the front surface of the core and also along the smoothly conforming side walls of the cavities. It is this lower density material which is more effective in absorbing higher frequency sounds. On the other hand, the lower frequency sounds have a greater penetration than the higher frequency sounds, and effectiveness is therefore not lost by having the higher density core materials toward the rear surface of the core.

Still another factor in absorbing higher frequency incident sound is the fact that by forming the cavities in the manner described, the surface area of the front surface of the core is increased substantially, and the larger the surface area of sound-absorbing material, the greater is its effectiveness.

Figure 5:
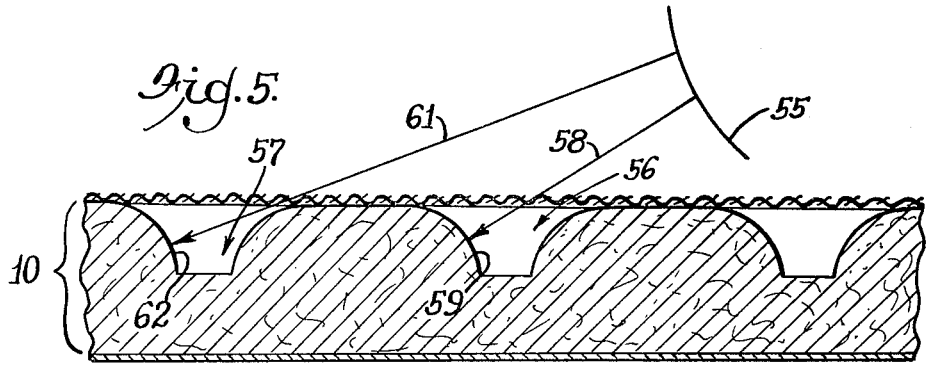
FIG. 5 is a fragmentary close up horizontal cross-sectional view of the core of FIG. 1 illustrating the effect of incident sound at a flanking angle.

Turning now to FIG. 5, a quantitative explanation will be given concerning the effectiveness of a panel constructed according to the present invention in absorbing incident sounds at flanking angles—that is, at angles of incidence less than about 45 degrees relative to the surface of the panel. A sound pressure wave propagates in a spherical pattern, diagrammatically illustrated by the circular line 55. Considering the incidence of this waveform on the side walls of adjacent cavities 56 and 57, a first line 58 represents an idealized path taken by the wave front which is perpendicular to the side wall 59 of the cavity 56. Similarly, as the wave front propagates toward the adjacent cavity 57, a line 61 represents a idealized path having a perpendicular angle of incident on the side wall 62 of the cavity 57. A number of factors come into play in absorbing incident sound. One of them, as illustrated by the directional lines 58, 61 enhances penetration of the sound wave into the absorbing material because the incident wave is perpendicular to the surface of the material. Where, as in the case of the instant invention, the surface material is selected to have high absorption characteristics for high frequency sound, the absorption will be good. A second factor in absorbing high frequency energy, as explained above, is the effect of the cavity itself, which is provided with a permeable membrane such as the cloth covering 43. At least some of the high frequency energy will be trapped within the cavity and be absorbed in the vibration of the air molecules within the cavity. Still further, considering that the angle of reflection must be equal to the angle of incidence, for such high frequency sound energy as does reflect off the surface of the core, the reflected sound will be dispersed and there will be a reduction in articulation due to the curvature of the outer surface of the core. Therefore, its distracting effect will be lessened.

EXAMPLE

Figure 4:
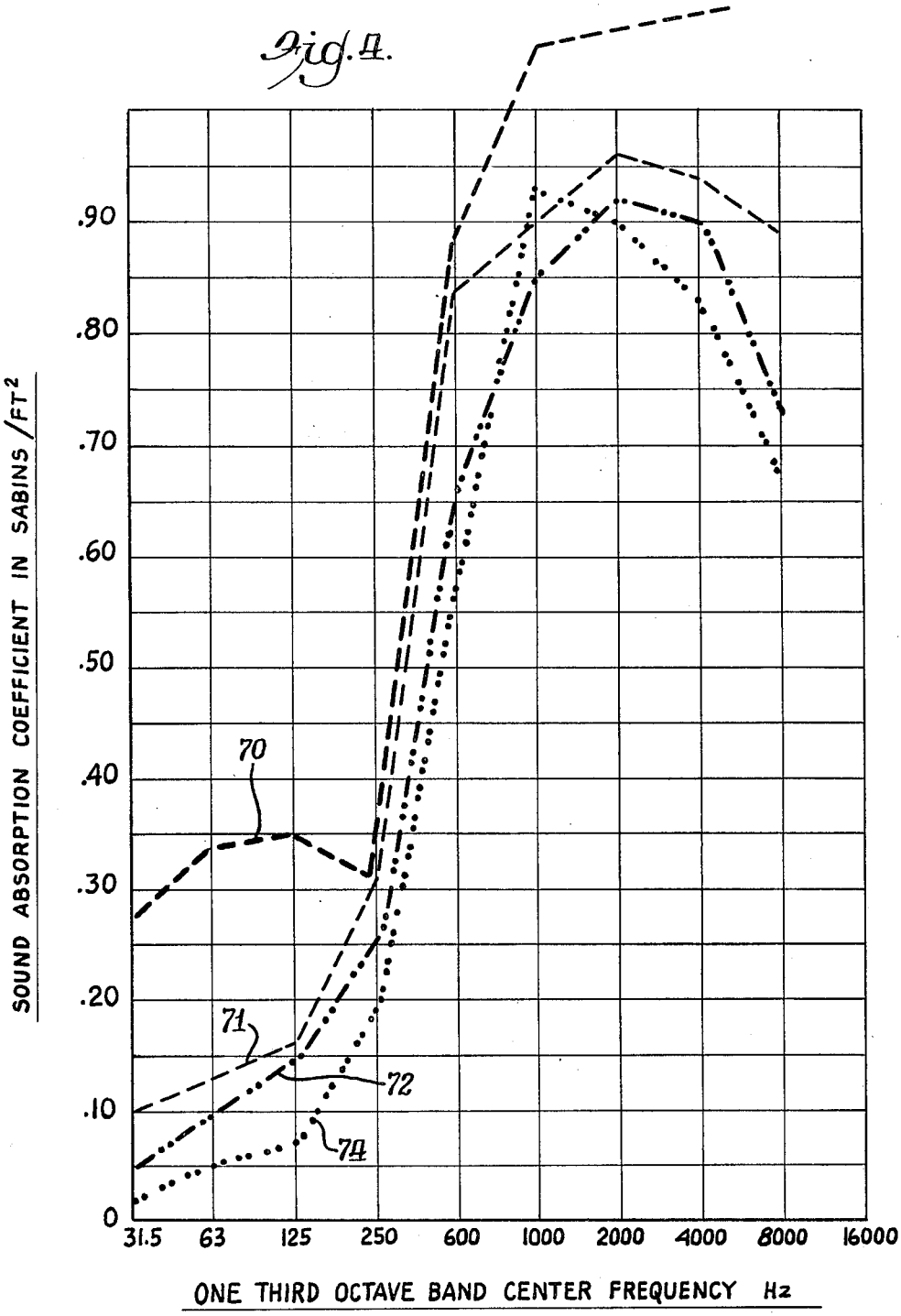
FIG. 4 is a graph showing the sound absorption coefficients vs. frequency for various acoustical panels.

In a preferred embodiment of the invention, for use in open plan offices and the like, three layers of glass fiber (or "fluff") having a nominal density of one pound per cubic foot and a thickness varying between one and two inches are compressed in a heated mold into a panel having a nominal thickness of one inch. The stubs or rods in the mold used to form the cavities are $\frac{5}{8}$ in. in depth. The diameter of the rods or pins is $\frac{5}{8}$ in. The center-to-center spacing of cavities along the side of a square for the grid pattern shown in FIG. 1, is 1.45 in., and the center-to-center diagonal spacing is 2.1 in. The septum, as indicated, is aluminum foil having a thickness of 1 mil.; and the stretched permeable membrane is a conventional upholstery fabric. The sound absorption of a panel thus constructed was measured, and the results are shown in FIG. 4, as indicated by curve 70. In this graph, the abscissa is frequency (arranged in one-third octave band center frequencies), and the ordinate is the sound absorption coefficient in Sabins per square foot.

The curve 71 represents the absorption characteristic of the same panel without the covering fabric, thereby indicating the effectiveness of the absorption of the cavities by trapping air sound at the higher frequencies—particularly in the intelligibility range of speech. The curve 72, for comparison purposes, represents the sound absorption characteristic of a one-inch thick multi-density board having a density variation from three to six pounds per cubic inch. The curve 74 illustrates the sound absorption characteristic over the same frequency range for a standard one-inch thick glass fiberboard of uniform density of six pounds per cubic inch.

The Nose Reduction Coefficient (NRC) is another industry figure used to determine sound absorption. It is calculated by taking the average of the sound absorption coefficients at 250, 500, 1000 and 2000 Hz, and is expressed to the nearest multiple of 0.05. For the panels described above and associated respectively with the curves 70, 72 and 74, the NRC values were measured to be 0.85, 0.70 and 0.65—the higher figure being representative of greater noise reduction.

Some variation can be made in the dimensions given above while maintaining an improved acoustical performance for a panel of the type described. For example, the length of the pins or stubs used in the mold to form the cavities (which defines the depth of the cavities) for a one-inch thick core is preferably in the range of $\frac{1}{4}$–$\frac{3}{8}$ in. Typically, it will be 25–40 percent of the thickness of the core. The diameter of the rods or pins is selected primarily to give the smooth conformation in the side walls of the cavities and the pillow shape to the sections of the core between the cavities. For the closer spacing of adjacent cavities, the profile of the "pillow" portion between cavities approximates a sine wave. Preferably the diameter of the rods is ⅜ in. or more. Again, depending upon the frequency characteristic desired, the spacing of the centers of the cavities may be varied, and more than one spacing may be used. However, to increase the absorption of sound noise in the intelligibility range of human perception, the center-to-center spacing of cavities is in the range of 1.20–2.50 in. and to broaden the range of enhanced absorption, the cavity spacings should have two or more values in this range.

By constructing a panel in the manner described, the area of the outer surface of the core which is effective in absorbing incident sound is increased by approximately 18 percent.

In summary, the dimensions and spacing of the cavities for the preferred embodiment are designed to absorb sound at the dominant speech frequencies at the lower end of the intelligibility range, taking into account the parameters of practical sound absorption and available forming processes. Absorption at higher frequencies in this range is further enhanced under diffusion/diffraction theory because the irregular surface characteristic of the material has been maintained and because the effective surface area of absorbent material has been increased by approximately 18 percent due to the formation of the cavities in the desired pattern.

Having thus disclosed in detail preferred embodiments of the invention, persons skilled in the art will be able to modify certain of the dimensions which have been given and substitute equivalent materials for those disclosed while continuing to practice the principle of the invention; and it is, therefore, intended that all such modifications and substitutions be covered as they are embraced within the spirit and scope of the appended claims.

I claim:

1. An acoustical panel comprising: a core material formed of a plurality of stratified layers of glass fiber pressed together under heat and pressure to form a board having a front surface and a rear surface, the average density of each layer increasing from said front surface to said rear surface and being in the range of approximately two-six pounds per cubic foot respectively, said front surface defining a plurality of cavities extending partially inwardly of said front surface and having outwardly flared side walls, the center-to-center spacing of said cavities being selected to correspond to the quarter wave length of sound in the intelligibility range of human speech and being spaced substantially entirely throughout said front surface, said cavities being individually sized to absorb sound at the intelligibility range of speech, the front stratified layer extending into and lining the side walls of said cavities to enhance absorption of sound at higher frequencies in the intelligibility range and being rounded to increase surface area and to increase sound absorption at flanking angles of incidence; a septum covering the rear surface of said core; and a permeable membrane covering the front surface of said core and extending over said cavities to permit sound pressure waves to enter and be trapped in said cavities; said panel characterized in having its minimum sound absorption at frequencies less than about 400 cycles per second to absorb sound at such low frequencies in a controlled, reduced manner.

2. The structure of claim 1 wherein the center-to-center spacing of said cavities is in the range of 1.2–2.50 in.

3. The apparatus of claim 1 wherein each of said cavities is defined by a generally flat bottom wall located in the range of 25–40 percent of the thickness of said panel from said front wall; and a side wall of circular cross section, said side wall increasing in smooth conformation from said bottom wall to the outer surface of said core.

4. The apparatus of claim 3 wherein said cavities are arranged in a grid-like pattern substantially throughout said front surface and wherein the material between said cavities is in the general shape of a pillow to provide a varying curvature to incident sound pressure waves at a flanking angle, thereby to reduce the reflection of sound at a flanking angle.

5. The apparatus of claim 1 characterized in that the outer layers of said core material is preserved in softness and has a density of approximately two pounds per cubic foot, and wherein the surface of said core is increased approximately 18 percent by the formation of said cavities.

6. The apparatus of claim 1 wherein said panel is characterized as having an increasing sound absorption coefficient in the range of 1000–8000 Hz.

7. The apparatus of claim 1 wherein the centers of said cavities are arranged in a generally rectangular grid work such that four adjacent cavities are centered on the corners of a generally square shape, the center-to-center spacing of said cavities along the side of said square being approximately 1.45 and the center-to-center spacing of said cavities along diagonals of said squares being approximately 2.1 inches to enhance the coupling of sound energy in the lower portion of the intelligibility range into said cavities for absorption.

* * * * *